US005091999A

United States Patent [19]

Turner, Jr.

[11] Patent Number: 5,091,999

[45] Date of Patent: Mar. 3, 1992

[54] COMMODE SEAT ORGANIZATION

[76] Inventor: Anthony L. Turner, Jr., 1058 Crystal St., Angleton, Tex. 72515

[21] Appl. No.: 597,554

[22] Filed: Oct. 15, 1990

[51] Int. Cl.[5] ..... A47K 13/26

[52] U.S. Cl. ..... 4/237

[58] Field of Search ..... 4/234, 237, 239, 240, 4/238, 242, 248

[56] References Cited

U.S. PATENT DOCUMENTS

| | | | |
|---|---|---|---|
| 1,004,521 | 9/1911 | Ainsworth | 4/237 X |
| 2,404,124 | 7/1946 | Des Roches | 4/251 X |
| 3,055,015 | 9/1962 | Silverman | 4/240 |
| 3,593,349 | 7/1971 | Bungo | 4/237 X |
| 3,613,130 | 10/1971 | Sansone | 4/240 |
| 4,384,375 | 5/1983 | Gerome | 4/236 X |
| 4,451,940 | 6/1984 | Grunz | 4/237 X |
| 4,707,870 | 11/1987 | Glassco et al. | 4/237 X |
| 4,747,167 | 5/1988 | Adams | 4/237 X |
| 4,893,360 | 1/1990 | Wofford | 4/237 |

FOREIGN PATENT DOCUMENTS

| | | | |
|---|---|---|---|
| 2008370 | 9/1979 | Fed. Rep. of Germany | 4/240 |
| 375167 | 6/1932 | United Kingdom | 4/237 |

*Primary Examiner*—Charles E. Phillips
*Attorney, Agent, or Firm*—Leon Gilden

[57] ABSTRACT

An apparatus wherein a commode seat is selectively mounted to overlie a commode in a coextensive relationship utilizing fastening members to provide enhanced securement of the commode seat to the underlying commode. The fastening members each include an elongate shank at an upper end thereof and diametrically opposed blades mounted adjacent an end thereof to secure the commode seat to the underlying commode.

1 Claim, 3 Drawing Sheets 10
11
12
12a
14
14a
15
16
17
18
19

16
14
20
20
15
15
12
12a
12a
21
21
11a
11
23
22
24
25

14
17
16
17
15

COMMODE SEAT ORGANIZATION

BACKGROUND OF THE INVENTION

1. Field of the Invention

The field of invention relates to commode apparatus, and more particularly pertains to a new and improved commode seat organization wherein the same includes a selectively removable and securable commode seat mounted to an associated commode member.

2. Description of the Prior Art

Various commode organization have been utilized in the prior art to produce a sanitary commode seat of a readily replaceable and positionable arrangement for securement to an associated commode. Prior art organizations have included various fastening members to mount a commode seat to a commode and include U.S. Pat. No. 4,707,870 to Glassco wherein a clip-like retaining member is mounted to the commode seat to maintain the commode seat in a vertical orientation relative to an underlying commode.

U.S. Pat. No. 2,404,124 to Roches provides for a strap construction to fixedly maintain a commode seat in a fixed relationship relative to an underlying commode in a particular relationship.

U.S. Pat. No. 3,593,349 to Bungo sets forth an improved toilet seat provided with an acoustical liner for enhancing containment of sounds projected within the commode bowl of the organization.

U.S. Pat. No. 4,451,940 to Grunz sets forth a commode seat and cover utilizing a cushion organization including magnetic elements to prevent the seat from falling down while in use and thereby maintain the lid and seat in a raised orientation relative to an underlying commode bowl to provide ease of cleaning of the commode bowl.

U.S. Pat. No. 4,747,167 to Adams sets forth a commode seat utilizing a clamping arrangement to prevent angular shifting of the toilet seat assembly during use.

As such, it may be appreciated that there continues to be a need for a new and improved commode seat organization as set forth by the instant invention which addresses both the problems of ease of use as well as effectiveness in construction providing sanitary and readily replaceable commode seats relative to associated commodes and in this respect, the present invention substantially fulfills this need.

SUMMARY OF THE INVENTION

In view of the foregoing disadvantages inherent in the known types of commode seats now present in the prior art, the present invention provides a commode seat organization wherein the same provides for readily mounted commode seat for securement to an underlying commode, wherein the seat is mounted in a non-hinged relationship relative to the commode and provides ready ease of replacement of the commode seat and its assembly from the associated commode. As such, the general purpose of the present invention, which will be described subsequently in greater detail, is to provide a new and improved commode seat organization which has all the advantages of the prior art commode seats and none of the disadvantages.

To attain this, the present invention provides an apparatus wherein a commode seat is selectively mounted to overlie a commode in a coextensive relationship utilizing fastening members to provide enhanced securement of the commode seat to the underlying commode. The fastening members each include an elongate shank at an upper end thereof and diametrically opposed blades mounted adjacent an end thereof to secure the commode seat to the underlying commode.

My invention resides not in any one these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode seat organization which has all the advantages of the prior art commode seats and none of the disadvantages.

It is another object of the present invention to provide a new and improved commode seat organization which may be easily and efficiently manufactured and marketed.

It is a further object of the present invention to provide a new and improved commode seat organization which is of a durable and reliable construction.

An even further object of the present invention is to provide a new and improved commode seat organization which is susceptible of a low cost of manufacture with regard to both materials and labor, and which accordingly is then susceptible of low prices of sale to the consuming public, thereby making such commode seat organizations economically available to the buying public.

Still yet another object of the present invention is to provide a new and improved commode seat organization which provides in the apparatuses and methods of the prior art some of the advantages thereof, while simultaneously overcoming some of the disadvantages normally associated therewith.

Still another object of the present invention is to provide a new and improved commode seat organization wherein the same sets forth a lid conveniently and readily mounted to an underlying commode for ease of replacement thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 4:
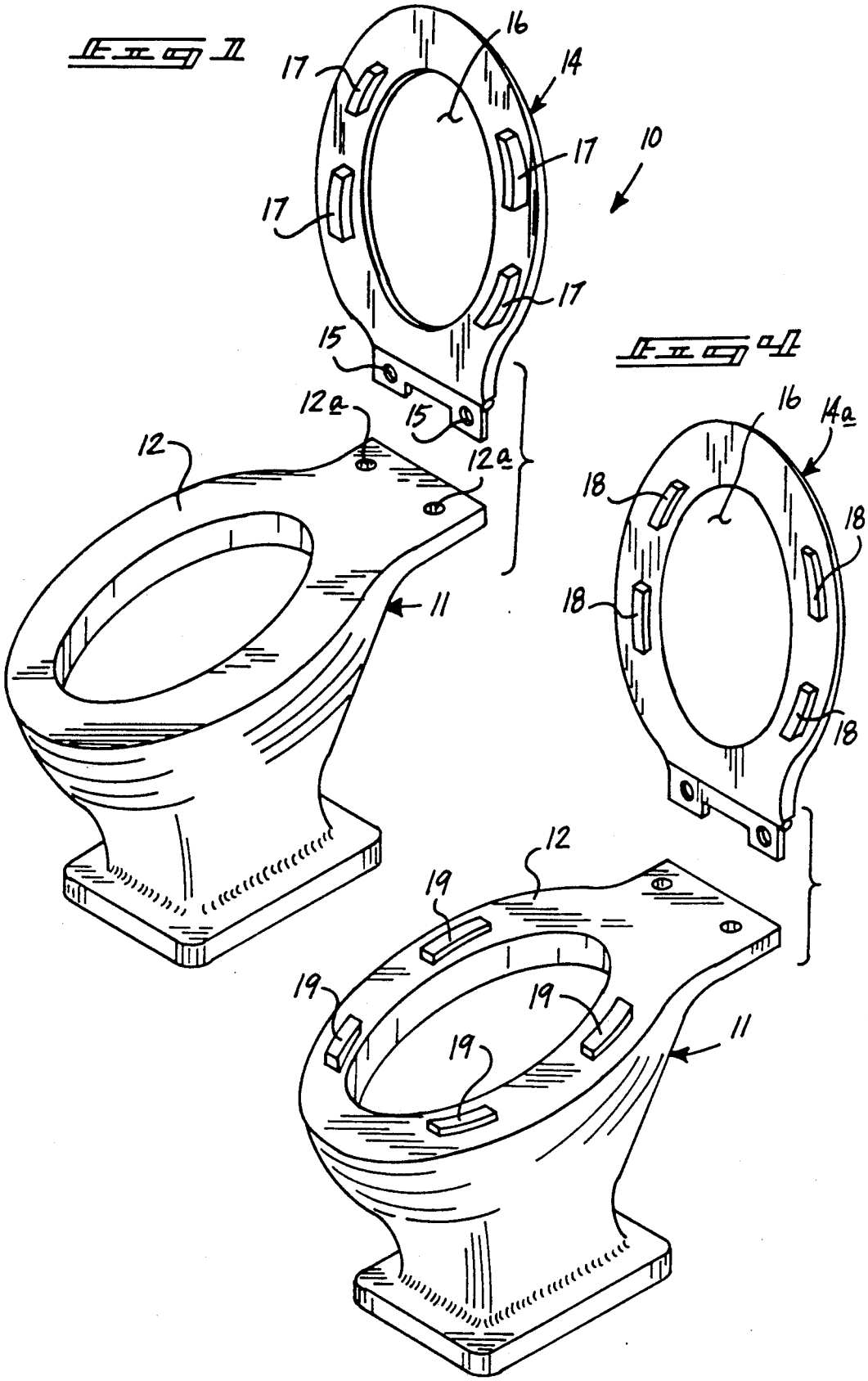
FIG. 1 is an isometric illustration of the instant invention.
FIG. 4 is an isometric illustration of a further modification of the instant invention utilizing magnetic securement members.

With reference now to the drawings, and in particular to FIGS. 1 to 7 thereof, a new and improved commode seat organization embodying the principles and concepts of the present invention and generally designated by the reference numeral 10 will be described.

Figure 3:
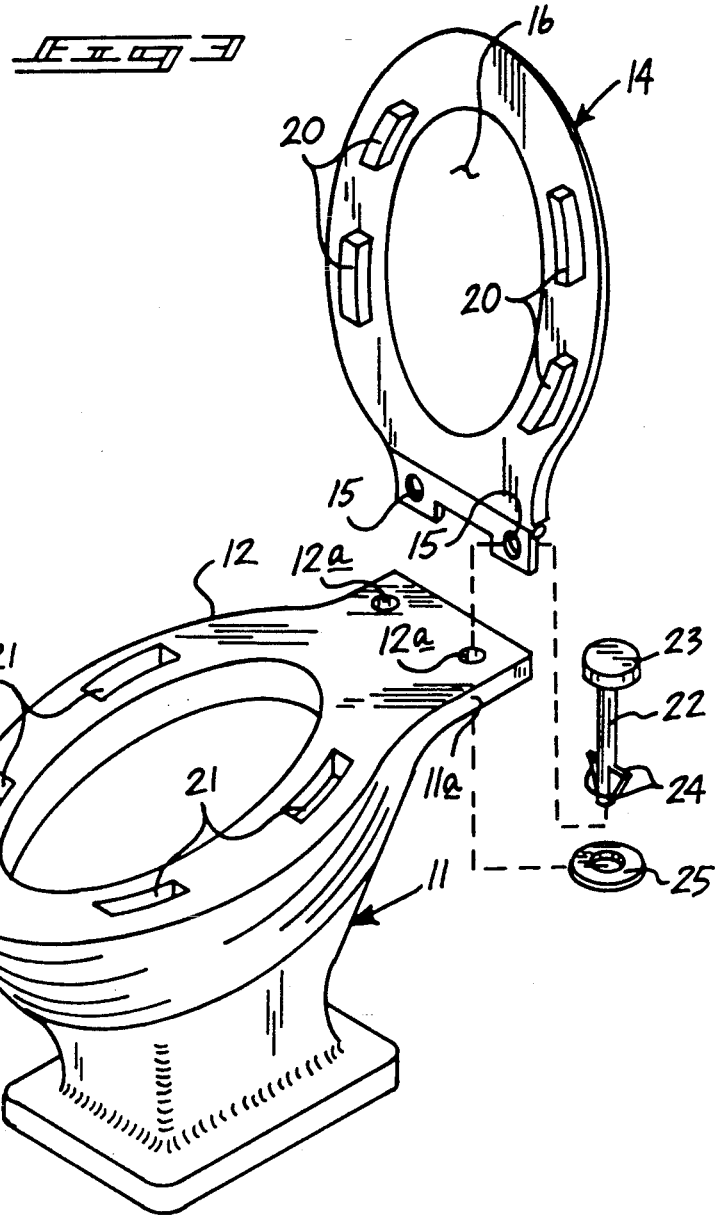
FIG. 3 is an isometric illustration of the invention utilizing a modified commode bowl to fixedly accommodate the commode seat.
Figure 2:
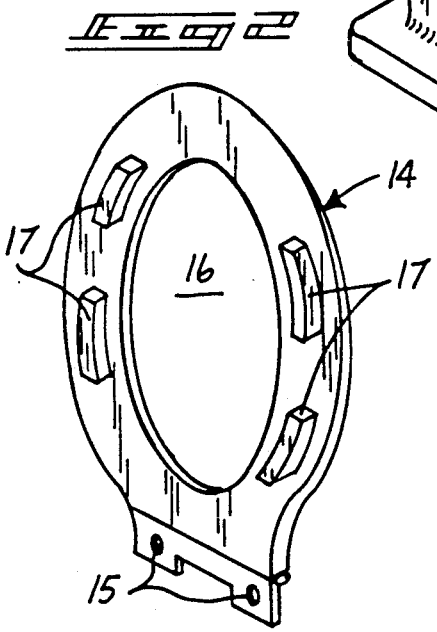
FIG. 2 is an isometric illustration of the seat organization of the instant invention.

More specifically, the commode seat organization 10 of the instant invention essentially comprises a commode 11, including a commode top planar surface 12 defined about a central commode bowl, with a plurality of through-extending bores 12*a* spaced apart a predetermined spacing and directed through the commode bowl adjacent a rear terminal end thereof. A commode seat 14 of a rigid ring-like member includes a plurality of commode seat apertures 15 spaced apart the aforenoted predetermined spacing for alignment with the bores 12*a*. The commode seat includes an elliptical central opening 16 arranged to overlie the commode bowl, with the seat 14 positionable upon a top planar surface 12. Plural pairs of support strips 17 are provided and may be formed of a polymeric frictional material to enhance frictional engagement with the top surface 12*a*. Alternatively, (with reference to FIG. 4) first plural pairs of magnetic strips 18 are mounted to the bottom surface of the commode seat 14 on opposed sides of the central opening 16 and are selectively cooperative with second magnetic strip pairs 19 mounted in equal spacing as the first magnetic strips pairs 18 to each side of the commode bowl and mounted on the top surface 12. FIG. 3 illustrates the use of the commode seat utilizing further strip projection pairs 20 mounted to each side of the central opening 16, with the further strip pairs 20 selectively formed of a magnetic material and complementarily receivable within groove pairs 21 which may optionally be formed of a magnetically attractable type material or liner to enhance securement of the seat 14 relative to the commode 11. It is further contemplated that fastener members, including a fastener shaft 22 with a fastener head 23 orthogonally mounted to the top terminal end of the fastener shaft 22 be provided. The shaft further includes triangular elastomeric projections 24 that are diametrically mounted adjacent a lower terminal end of the shaft 22 to permit directing the projections 24 through the commode seat apertures 15 and the bores 12*a*, with the use of a fastener ring 25 mounted to a bottom surface of the commode flange 11*a* to ensure the use of a planar engagement surface when the projections 24 are directed through the bores 12*a* and a respective fastener end 25.

Figure 5:
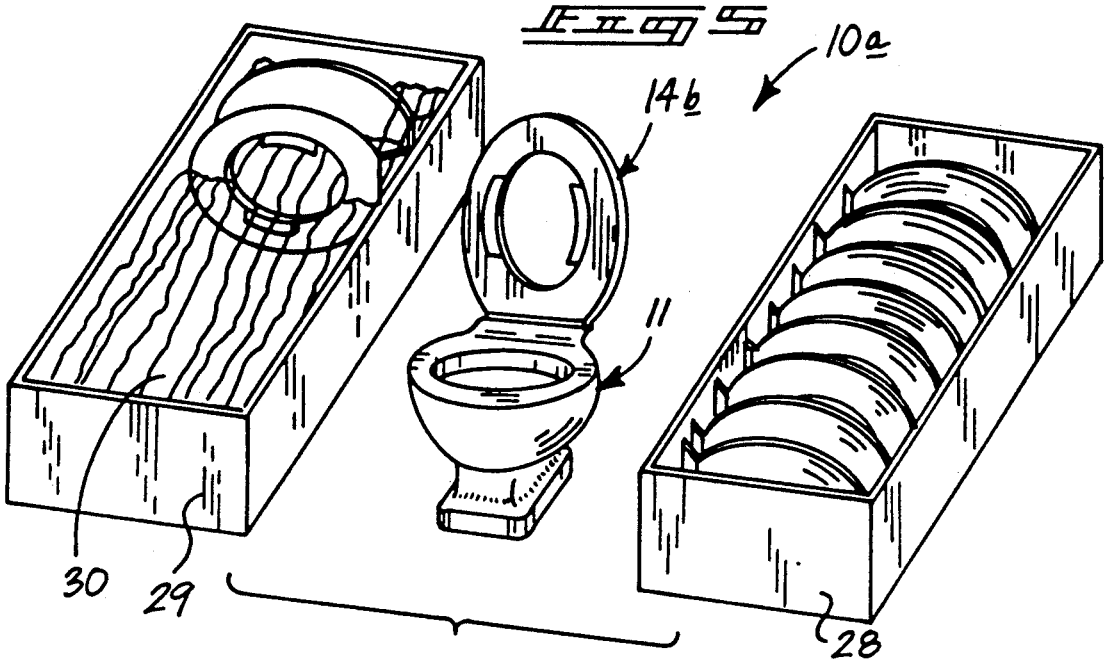
FIG. 5 is an isometric illustration of the organization of the instant invention setting forth the use of commode seats to be sanitized and recycled during use.
Figure 6:
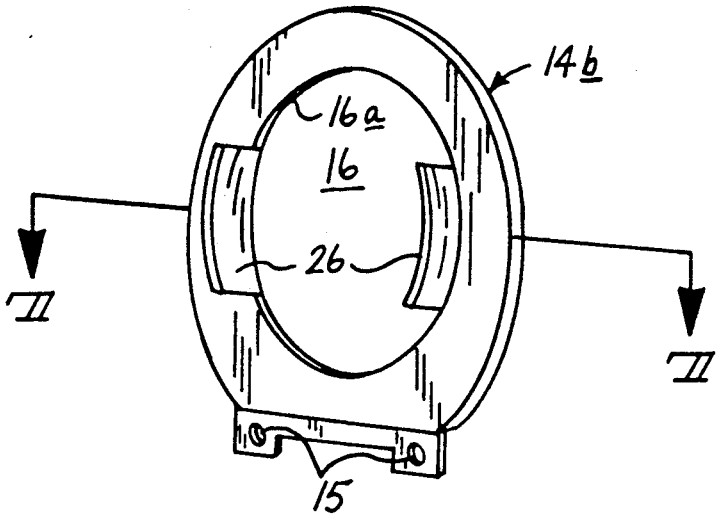
FIG. 6 is an isometric illustration of a yet further modified commode seat utilized by the instant invention.
Figure 7:
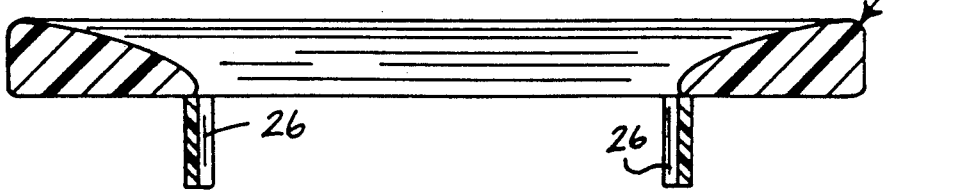
FIG. 7 is an orthographic view, taken along the lines 7—7 of FIG. 6, in the direction indicated by the arrows.

Reference to FIG. 5 illustrates a modified commode seat organization 10*a* wherein a further modified commode seat 14*b* is selectively provided with arcuate positioning blades 26 mounted orthogonally to a bottom planar surface of the seat 14*b* at the perimeter edge 16*a* of the central opening 16. The blades 26 are diametrically opposed relative to the opening 16*a* along a minor axis of the elliptical opening for engagement within an interior surface of the commode seat bowl to maintain alignment thereof and may selectively be mounted utilizing the fastener structure, as illustrated in FIG. 3, incorporating the commode seat apertures 15. The use of a first storage container 28 is provided for storage of a series of commode seats from the commode seats 14, 14*a*, or 14*b*. Subsequent to their use, each commode seat is positioned within a sanitizing container 29 containing a germicidal and sanitizing fluid 30 therewithin. Subsequently, each rigid seat 14 may be recycled and utilized again relative to use of the associated commode 11.

It is understood that the commode seat organizations 14, 14*a*, and 14*b* are of a rigid non-hinged construction, with the apertures 15 directed through the rearwardly projecting flange of each commode seat to permit fixed alignment of each commode seat relative to the underlying commode 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode seat in combination with a commode organization arranged for sanitizing and recycling of a commode seat relative to a commode, wherein the commode includes:

a commode opening surrounded by a top planar surface with the top planar surface including a commode flange directed rearwardly of the top planar surface, said commode flange including a plurality of through-extending bores spaced apart a predetermined distance;

a commode seat including a rigid ring member with a central opening, the seat including a seat flange directed rearwardly of the opening, and including a plurality of commode seat apertures spaced apart said predetermined distance for alignment with the through-extending bores;

plural pairs of support strips mounted to each side of a bottom surface of the seat;

wherein the central opening is elliptical, and the commode seat flange is orthogonally oriented relative to a major axis of the elliptical opening;

wherein the support strips are magnetic and a plurality of groove pairs are located in the top surface of the commode on opposed sides of the central opening, wherein each groove includes a magnetically attractive material therewithin and the support strips magnetically attract and secure a respective support strip within a respective groove; and a fastening member selectively and removably mounted through each commode seat aperture and through each bore of the commode, wherein each fastener includes an elongate fastener shaft, with a fastener head orthogonally mounted to an upper end thereof; and a plurality of elastomeric projections diametrically mounted adjacent a lower terminal end of the fastener shaft, which projections cooperate with a fastener ring, located on an under surface of the commode flange, in order to secure said seat flange to said commode flange for easy disengagement therefrom.

* * * * *